United States Patent [19]

Gannaway

[11] Patent Number: 4,639,198

[45] Date of Patent: Jan. 27, 1987

[54] SUCTION TUBE SEAL FOR A ROTARY COMPRESSOR

[75] Inventor: Edwin L. Gannaway, Adrian, Mich.

[73] Assignee: Tecumseh Products Company, Tecumseh, Mich.

[21] Appl. No.: 830,500

[22] Filed: Feb. 20, 1986

Related U.S. Application Data

[63] Continuation of Ser. No. 670,306, Nov. 13, 1984, abandoned.

[51] Int. Cl.[4] ..... F04B 17/00; F04B 35/04

[52] U.S. Cl. ..... 417/410; 417/902

[58] Field of Search ..... 417/902, 363, 366, 410; 137/590; 285/158

[56] References Cited

U.S. PATENT DOCUMENTS

| | | | |
|---|---|---|---|
| 2,214,086 | 9/1940 | Rataiczak | 62/115 |
| 2,373,909 | 4/1945 | Penn . | |
| 2,973,011 | 2/1961 | Klare | 137/590 |
| 3,031,861 | 5/1962 | McCormack | 62/196 |
| 3,209,991 | 10/1965 | Sauber . | |
| 3,401,602 | 9/1968 | Birdwell . | |
| 3,515,497 | 6/1970 | Studebaker et al. . | |
| 3,542,405 | 11/1970 | Nalooka | 285/158 |
| 3,767,334 | 10/1973 | Rinehart | 417/902 |
| 3,806,977 | 4/1974 | Anderson . | |
| 3,870,440 | 3/1975 | Zuercher, Jr. | 417/902 |
| 3,871,800 | 3/1975 | Slayton | 418/248 |
| 4,129,503 | 12/1978 | Joseph | 137/590 |
| 4,160,625 | 6/1979 | Dyhr et al. | 417/363 |
| 4,240,774 | 12/1980 | Ladusaw | 417/902 |
| 4,245,858 | 1/1981 | Cox | 285/158 |
| 4,277,211 | 7/1981 | Kanger . | |
| 4,518,324 | 5/1985 | Mizuno et al. | 417/366 |
| 4,518,330 | 5/1985 | Asami et al. | 417/313 |

FOREIGN PATENT DOCUMENTS

| | | |
|---|---|---|
| 3312564 | 11/1983 | Fed. Rep. of Germany . |
| 2370244 | 6/1978 | France . |
| 57-129285 | 8/1982 | Japan . |

*Primary Examiner*—Carlton R. Croyle
*Assistant Examiner*—Donald E. Stout
*Attorney, Agent, or Firm*—Anthony Niewyk; Albert L. Jeffers

[57] ABSTRACT

In a rotary hermetic compressor, a suction tube seal is provided between the cylinder and the suction tube. The suction tube end extends through the housing of the hermetic compressor and is sealingly secured thereto such as by welding. The compressor cylinder, which is located in the housing has an aperture in the cylindrical wall thereof for receiving the end of the suction tube extending into the housing. The inside diameter of the aperture is greater than the outside diameter of the suction tube so that the suction tube is slidably axially received in the aperture. The suction tube is sealed to the cylinder by flexible sealing means which is interposed between the outside of the suction tube and the inside of the aperture. The sealing means is preferably an O ring constructed of oil resistant, flexible rubber material.

7 Claims, 6 Drawing Figures

SUCTION TUBE SEAL FOR A ROTARY COMPRESSOR

This is a continuation of application Ser. No. 670,306, filed Nov. 13, 1984, now abandoned.

BACKGROUND OF THE INVENTION

This invention pertains to hermetic rotary compressors for compressing refrigerant in refrigeration systems such as air conditioners, refrigerators, and the like. In particular, the invention relates to the manner of sealing the suction tube to the cylinder in a rotary hermetic compressor.

In general, prior art hermetic rotary compressors comprise a housing which is hermetically sealed. Located within the housing are an electric motor and a compressor mechanism. The electric motor is connected to a crankshaft which has an eccentric portion thereon. The eccentric portion of the crankshaft is located within a bore of the compressor cylinder. A roller located within the bore is mounted on the eccentric portion of the crankshaft and is driven thereby. The roller cooperates with a sliding vane to compress refrigerant within the bore of the cylinder.

Rotary hermetic compressors of the type herein disclosed generally have a pressurized or high side sealed housing. The compressor is connected into a refrigeration circuit by means of suction and discharge tubes. In the prior art compressors the motor stator may be secured to the interior wall of the housing by shrink fitting and the compressor cylinder is generally welded to the housing. A motor rotor is journalled in a bearing and drives the crankshaft. The suction tube extends through the housing and is sealingly connected thereto. The end of the suction tube which extends into the housing is connected to the cylinder and conducts low pressure refrigerant directly to the cylinder bore for compression therein. The connection of the suction tube to the cylinder is usually made by press fitting or swedging the tube into an aperture in the cylinder wall. To that end, the suction tube outside diameter is made larger than the inside diameter of the cylinder aperture so that a good friction fit can be achieved.

The tolerances to which the cylinder, roller and vane must be manufactured are generally very exacting, such as ten thousandths of an inch. The reason for such very tight tolerances is that leakage of refrigerant in compressors must be minimized in order to achieve acceptable efficiencies of the compressor pumps. Since the assembly operations of welding the cylinder to the housing and pressing or swedging the suction tube into the cylinder aperture tend to distort the cylinder, thereby causing vane slot distortion and misalignment between the cylinder and the bearing, the prior art cylinders have generally been designed with a relatively large axial dimension so as to be of relatively heavy construction. By providing a thick, heavily constructed cylinder the press fitted suction tube is surrounded by sufficient cylinder material so that distortion is minimized, vane slot geometry and alignment of the bearings are preserved, and close tolerances are maintained. If distortion were not minimized and the dimensional tolerances could not be held during the welding and swedging operations, leakage in the compressor would become excessive.

In one prior art compressor having a low side housing the sealed connection of the suction tube to the suction muffler was made by means of an O ring. In this application of an O ring to a compressor structure the O ring did not provide a sealing connection between compressor areas of high pressure differentials such as the suction and discharge gas areas. Furthermore, this prior art compressor was of the reciprocating rather than the rotary variety so that there was no need for a thin cylinder to which the suction tube had to be sealingly connected and in which a large pressure drop existed across the sealed connection.

The prior art solution to the problem of providing a suitable sealed suction tube connection to the cylinder in a high side rotary compressor by using a thick cylinder and having the suction tube pressed therein has the disadvantage that it tends to increase the length of the refrigerant leakage paths and heat transfer surface thereby tending to decrease the efficiency of the compressor. During operation of the compressor there are areas of various pressure levels within the compressor. For instance, the bore of the compressor cylinder has both an inlet portion at suction pressure and a high pressure portion wherein the gas is compressed. Furthermore, the compressor housing itself is at high pressure because compressed refrigerant is expelled from the cylinder bore directly into the housing. As pointed out above, it is important to keep leakage of refrigerant from high pressure areas to low pressure areas to a minimum, since such leaked refrigerant represents lost work and reduces the efficiency of the compressor. Therefore, it is important that the lengths of the borders dividing low and high pressure areas are made as small as possible. It can be readily understood that the height of the cylinder is a critical dimension affecting leakage since it is directly related to the border length dividing the high and low pressure areas in the compressor cylinder bore. For instance, the length of the tip of the sliding vane which contacts the roller and the cracks between the vane and vane slot form a border dividing the high and low pressure cylinder bore areas. By using a thin cylinder this critical dimension can be kept small and the refrigerant leakage past the vane as well as other borders can be reduced.

An added disadvantage of the prior art thick cylinder construction is that the weight of the compressor is increased which is undesirable since the compressors are used in household appliances which are preferably of lightweight construction. Accordingly, a thin cylinder is desired.

Another disadvantage of prior art compressor structures has been that special shock absorbing structures had to be provided for the suction tube end extending into the compressor housing and located between the housing and the cylinder. Pressures in compressor housings tend to fluctuate and tend to rise as the compressor is shut down. Such pressure variations cause flexing of the housing. Since prior art suction tubes were secured to both the cylinder and the housing, the flexing of the housing due to varying pressures had to be accommodated to prevent rupturing of the suction tube seals with the housing and the cylinder. Thus, prior art structures provided shock tubes and other means to accommodate the stresses on the suction tube. It is, therefore, desired to accommodate the stresses on the suction tube in a simple manner while ensuring proper seals between the suction tube, the housing and cylinder.

The heavy construction of the cylinders of prior art compressors tended not only to increase the length of the leakage paths but also tended to increase the surface area available for heat transfer to incoming suction gas. Such heat transfer is undesirable and tends to decrease the efficiency of the compressor. It is, therefore, desirable that the heat transfer surface areas are minimized in order to optimize the efficiency of the compressor.

Another disadvantage of prior art rotary hermetic compressors is that in the sealing of the suction tube to the cylinder the use of fittings is necessitated thereby increasing the cost of the compressors due to the cost of parts and the cost of assembling the parts.

One further disadvantage of thick cylinders is that it tends to increase the size of the compressor. Since hermetic compressors are used in articles such as home appliances it is desirable that the size of the compressors is minimized.

SUMMARY OF THE INVENTION

The present invention overcomes the disadvantages of the above described prior art hermetic rotary compressors by providing an improved sealed connection between the suction tube and the compressor cylinder.

The invention, in one form thereof, provides in a hermetic rotary compressor a suction tube seal between the compressor cylinder and the suction tube. The suction tube extends through the compressor housing and is secured to the housing wall. The diameter of the suction tube end which extends into the housing is made slightly smaller than the diameter of the aperture in the cylinder which receives this suction tube end. An annular groove surrounds the aperture and receives a flexible O ring. The O ring seals the suction tube end slidably to the cylinder.

In a structure according to the present invention a hermetic compressor is provided having a housing and a cylinder. The cylinder has an aperture in the cylindrical wall thereof which communicates with the bore of the cylinder. A refrigerant suction tube extends through the compressor housing and is sealed thereto and furthermore extends into the cylinder aperture. The diameter of the suction tube is less than the diameter of the aperture. A flexible O ring surrounds the aperture and seals the suction tube to the cylinder so that the suction tube can slide within the aperture and can move axially with respect to the cylinder aperture as the housing flexes.

An advantage of the structure of the present invention is that by making a sliding sealed connection between the suction tube and the cylinder by means of an O ring arrangement, a thin cylinder can be used because no distortion forces will be placed on the cylinder during the assembling of the suction tube thereto. The use of a cylinder which has a small axial dimension reduces the lengths of the leakage paths formed by the borders dividing the low and high pressure areas of the compressor. For instance, the tip area of the sliding vane which contacts the roller and cracks in the vane slot are relatively small if the height of the compressor is relatively small. Thus, the amount of refrigerant which can leak from the high pressure side of the bore to the low pressure side of the bore past the vane tip and flanks are reduced, whereby the efficiency of the compressor is improved.

Another advantage of a compressor constructed in accordance with the present invention is that by using a thin cylinder, the amount of surface area available for heat transfer is reduced whereby less heat transfer will take place and the efficiency of the compressor is improved.

Yet another advantage of the structure of the present invention is that by using a sliding seal between the suction tube end and the compressor cylinder the need for means to absorb the flexing stresses of the housing relative to the cylinder due to varying pressures in the housing is eliminated, since the sliding seal formed by the O ring accommodates those stresses.

Still another advantage of a compressor constructed in accordance with the present invention is the elimination of special fittings for sealing the suction tube to the cylinder as well as the elimination of the swedging or pressing operation for securing the suction tube to the cylinder.

A still further advantage of a compressor constructed in accordance with a present invention is that by the elimination of the pressing or swedging operation the possibility of distortion of the compressor cylinder is eliminated and better bearing alignment and slot geometry are maintained, thereby decreasing leakage in the compressor and reducing excessive wear of the bearings.

A yet further advantage of the compressor according to the present invention is that by the use of a flexible O ring suction tube seal and a thin cylinder the size and weight of the compressor is decreased.

The compressor of the present invention, in one form thereof, comprises a housing, an electric motor secured to an inside wall of the housing and a crankshaft within the housing rotatably connected to the motor. A cylinder, located inside the housing, has a compression chamber therein within which a piston, operably connected to the crankshaft, compresses the refrigerant. A discharge means is located in the cylinder and is in operative association with the compression chamber for discharging compressed refrigerant into the compressor housing. An aperture in the cylinder wall communicates with the compression chamber. A suction tube extends through the housing and is sealingly connected thereto. The tube has one end thereof slidably received within the cylinder aperture. Flexible sealing means is interposed between the wall of the cylinder aperture and the tube wall for sealingly connecting the end of the tube to the cylinder.

There is further provided, in one form of the present invention, a rotary hermetic compressor comprising a housing and an electric motor operatively disposed within the housing and having a rotatable rotor. A suction tube is sealing secured to the housing and has end portions thereof extending into the housing. A cylinder is disposed within the housing in axial alignment with the rotor and is connected to the interior wall of the housing, the cylinder having a cylindrical bore therein. A rotatable crankshaft is received within the bore and is driven by the rotor for driving a piston means inside the bore and for compressing refrigerant therein. A discharge port is located in the cylinder for discharging compressor refrigerant from the bore and an aperture is located in the cylindrical wall of the cylinder and communicates with the bore. The suction tube end portion has a smaller outside diameter than the inside diameter of the aperture, the tube being axially slidably disposed within the aperture. Flexible sealing means is provided for sealing the suction tube end to the cylinder and for preventing refrigerant in the housing from leaking past the suction tube seal.

The rotary hermetic compressor of the instant invention still further provides, in one form thereof, a hermetically sealed housing, an electric motor sealed in the housing and secured to an inside wall thereof. A suction tube has an end thereof extending through the wall of the housing and is sealingly connected thereto for conducting refrigerant to the compressor. A crankshaft is connected to the motor and is rotatably driven thereby. A cylinder means is secured to the housing and has a bore therein, the wall of the cylinder having an aperture therein communicating with the bore. A suction tube end is slidably received in the aperture and flexible sealing means is interposed between the aperture and the outside wall of the tube for forming a seal between the suction tube and the compressed refrigerant portions of the housing. Adapter means is provided for connecting the tube to the housing, the adapter means comprising a first cylindrical flange, the tube extending through the flange and secured thereto, and a second cylindrical flange portion secured to the housing, the first and second portions being joined by a frusto-conical portion.

The invention still further provides in one form thereof a hermetic compressor including a housing, a cylinder secured to an inside wall of the housing and a suction tube having one end extending through a wall of the housing and sealingly secured to the housing. A suction tube seal for the compressor comprises an aperture in the cylinder, the aperture having an inside diameter larger than the outside diameter of the tube. The tube end is axially slidably received in the aperture and a sealing means is interposed between the tube end circumference and the wall of the aperture for sealing the tube to the aperture.

It is also an object of the present invention to provide an improved seal for a suction tube connection with the cylinder of a rotary hermetic compressor.

It is also an object of the present invention to eliminate the need to press fit or swedge a suction tube to the cylinder of a hermetic compressor whereby thin cylinders can be used thereby keeping refrigerant leakage losses to a minimum.

It is another object of the present invention to provide a compressor which is efficient, simple to construct and lightweight due to the ability to utilize a thin cylinder by means of a sliding suction tube seal.

It is yet another object of the present invention to provide a compressor which is energy efficient.

Another object of the present invention is the reduction of heat transfer in a compressor by means of a suction tube seal which permits the use of a thin cylinder thereby increasing the efficiency of the compressor.

Yet another object of the present construction is the elimination of a variety of fittings for connecting the suction tube to a compressor.

It is still another object of the present invention to provide a sliding seal between the cylinder and the suction tube whereby leakage in the compressor due to the flexing of the housing is prevented.

BRIEF DESCRIPTION OF THE DRAWINGS

The above mentioned and other features and objects of this invention and the manner of attaining them will become more apparent and the invention itself will be better understood by reference to the following description of an embodiment of the invention taken in connection with the accompanying drawings, wherein.

DESCRIPTION OF THE PREFERRED EMBODIMENT

Figure 1:
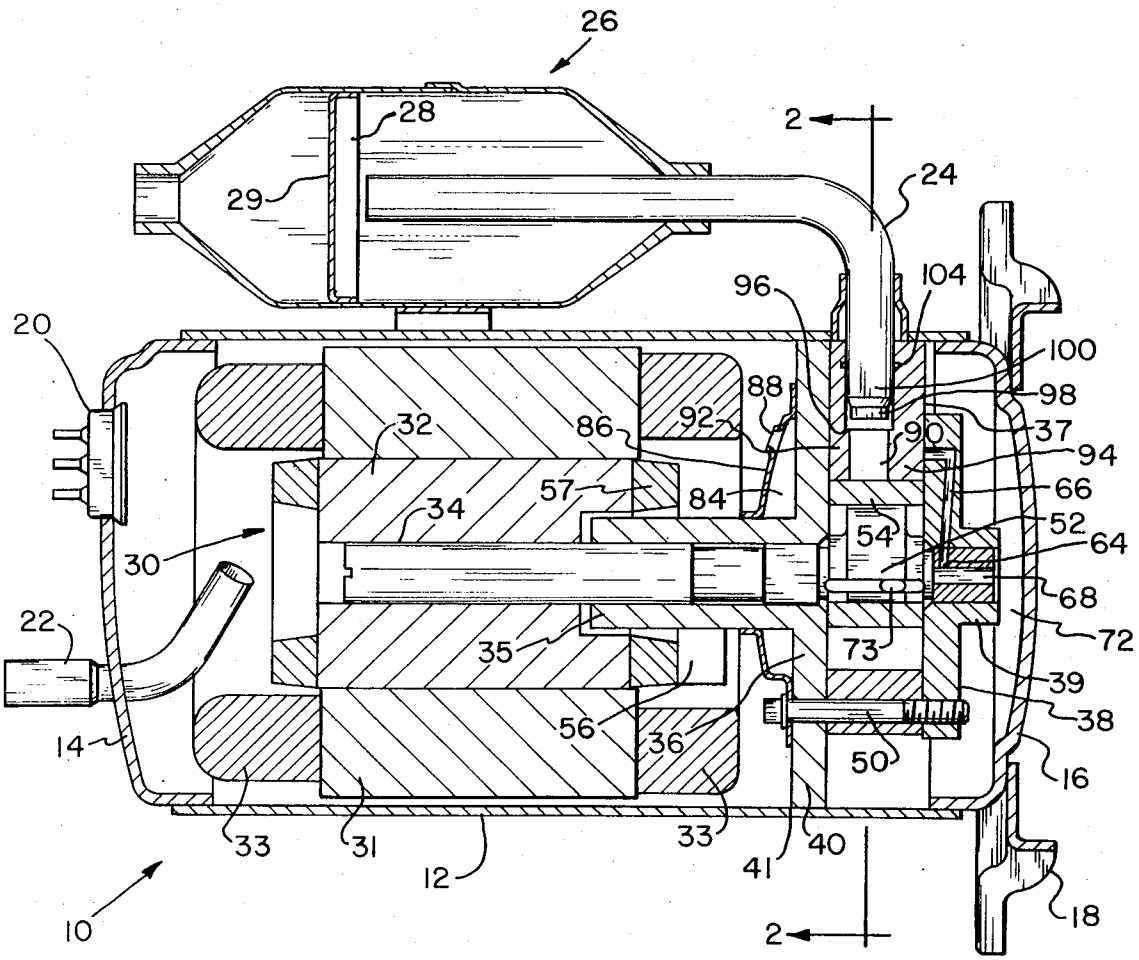
FIG. 1 is a broken away side sectional view of the compressor embodying one form of the present invention.

Referring to FIG. 1 there is shown a side sectional view of the compressor with the compressor disposed horizontally. A casing or housing 10 is shown having a cylindrical portion 12 and top and bottom portions 14 and 16, respectively. A flange 18 is shown welded to the bottom portion of the compressor. The flange is used for mounting the compressor when it is assembled to a refrigeration apparatus such as an air conditioner or refrigerator.

A terminal cluster 20 is provided for making electrical connections from a supply of electric power to the compressor motor. A discharge tube 22 extends through the top portion of the housing and into the interior of the compressor as shown. The tube is sealingly connected to the housing as by soldering. A suction tube 24 extends into the interior of the compressor housing as further described hereinbelow. The outer end of suction tube 24 is connected to an accumulator 26 which has support plates 28 disposed therein for supporting a filtering mesh 29.

An electric motor 30 is disposed within the compressor housing and includes a stator 31 and a rotor 32. The electric motor is an induction type of motor having a squirrel cage rotor. Windings 33 provide the rotating magnetic field for inducing rotational movement of the rotor. The cylindrical stator 31 is secured by interference fit to the interior wall of the housing 10 as by shrink fitting. In the shrink fitting process the housing 10 is heated so that it expands. Motor stator 31 is then inserted and positioned and the assembly is allowed to cool. As the assembly cools, the housing 10 will shrink and will securely grasp the motor stator 31.

A crankshaft 34 is secured to the hollow interior aperture of the rotor 32 by shrink fitting. The crankshaft 34 extends axially through an upper bearing 36, and a cylinder 37 into a lower or outboard bearing 38. The crankshaft is journalled in sleeve bearings 35 and 39. As best illustrated in FIG. 2 the main bearing 36 has three flanges 40 thereon for securing the bearing to the housing 10 at points 41 such as by welding.

Figure 6:
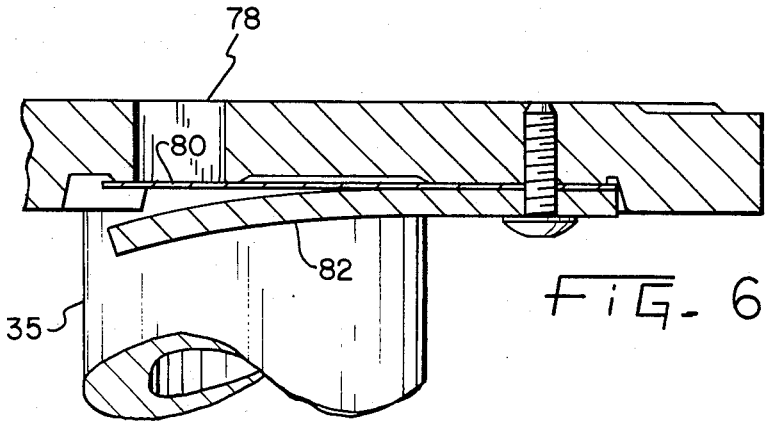
FIG. 6 is a sectional view of the main bearing assembly taken along line 6—6 of FIG. 5.
Figure 5:
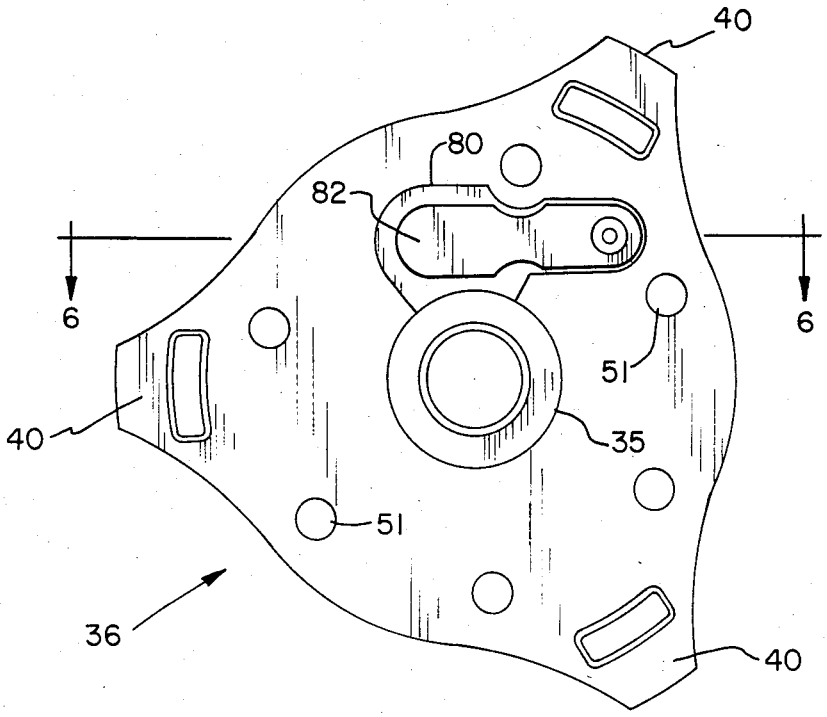
FIG. 5 is a plan view of the main bearing assembly.

As best illustrated in FIGS. 1, 5 and 6, the main bearing 36 comprises a relatively long sleeve bearing portion 35 for journalling or rotatably supporting crankshaft 34. Lower bearing 38 has a sleeve bearing portion 39 for journalling the end portion of crankshaft 34. Cylinder 37 and lower bearing 38 are secured to main bearing 36 by means of six bolts 50 as best illustrated in FIGS. 1 and 2. Bolts 50 extend through holes 51 in the main bearing and holes 44 in the cylinder block and are threaded into the lower bearing 38.

If the cylinder axial dimension permits, the six bolts 50 could be replaced with twelve bolts, six of which would secure outboard bearing 38 to the cylinder and be threaded into the cylinder. The remaining six bolts would secure main bearing 36 to the cylinder and be threaded into the cylinder.

Figure 2:
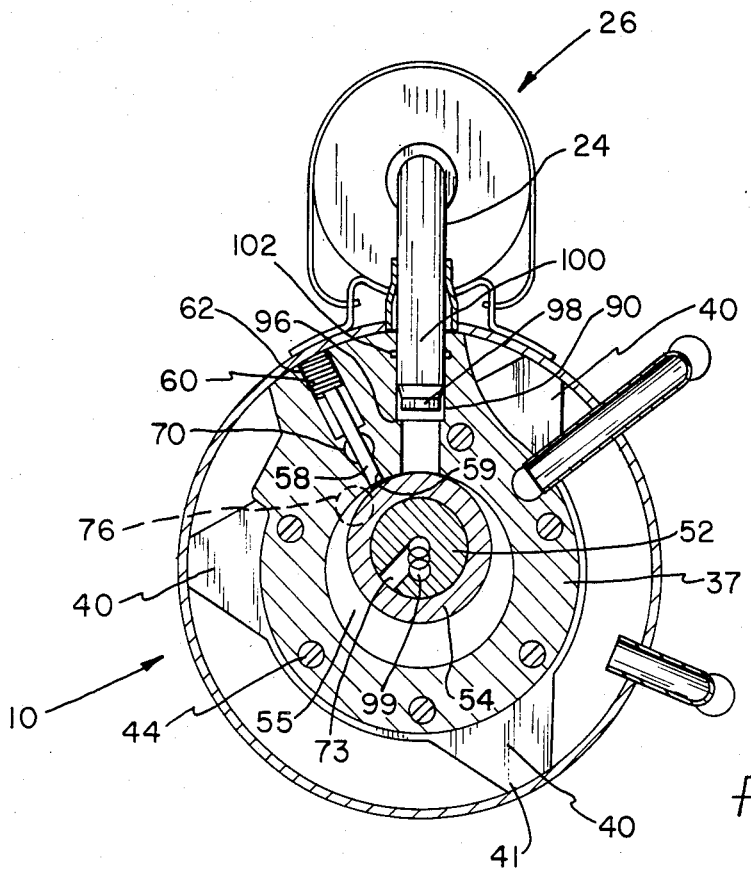
FIG. 2 is a broken away bottom sectional view of the compressor taken along the line 2—2 of FIG. 1.
Figure 3:
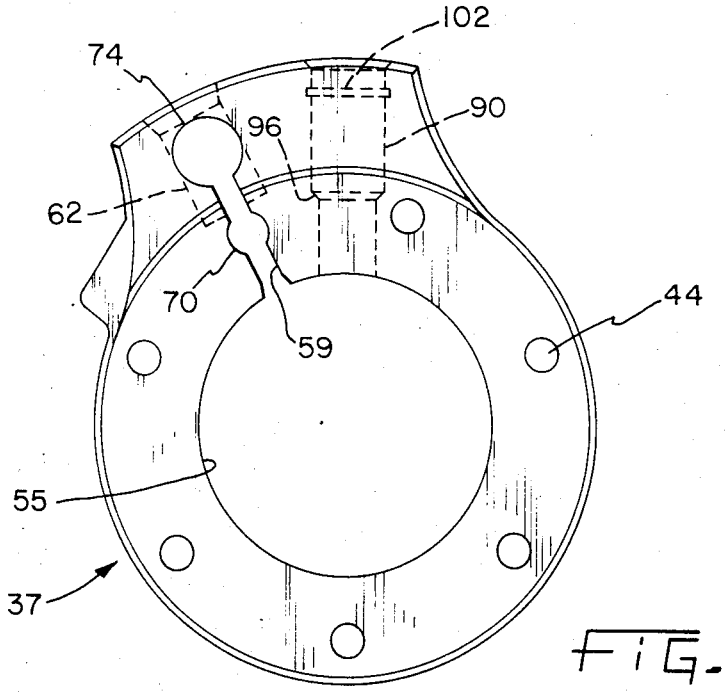
FIG. 3 is an enlarged plan view of the cylinder.

As best illustrated in FIGS. 1 and 2, crankshaft 34 has an eccentric portion 52 thereon for revolving eccentrically around the crankshaft axis. A cylindrical roller member 54 surrounds the eccentric and rolls around circular bore 55 as the eccentric revolves around the crankshaft axis. A counterweight 56 for counterbalancing the eccentric 52 is secured to the end ring 57 of the motor rotor such as by riveting. A rectangular sliding vane 58 is received in a vane slot 59. The vane slot 59 is located in the cylinder wall of cylinder 37. A spring 60 biases the end of vane 58 against the roller 54 for continuous engagement therewith. The spring 60 is received in a spring pocket 62 machined into the wall of the cylinder.

A lubrication hole 64 in shaft 34 communicates with lubrication passage 66 in outboard bearing 38. Passage 66 receives oil from a lubrication pump 68 disposed centrally in shaft 34. The oil is pumped upwardly by centrifugal force through the central opening in the shaft and is spun outwardly into radial passage 66 in outboard bearing 38. Shaft 34 has an annular opening (not shown) machined therein for communication of pump aperture 68 with passage 66. An oil passage 70 is provided adjacent vane 58 for lubricating the vane. Therefore, the oil will travel upwardly through passage 66 and through passage 70 adjacent vane 58 and will then exit on top of the cylinder from which it will run down over the cylinder by gravity back to the oil sump 72 in the lower portion 16 of housing 10. A radial oil lubrication hole 73 is provided in eccentric 52 of shaft 34 for lubricating the roller 54. The hole 73 communicates with pump aperture 68 in shaft 34 and receives oil therefrom. Another aperture 74 is provided in cylinder 37 to accommodate the rectangular end of vane 58.

In operation, as the roller 54 rolls around bore 55 refrigerant will enter the bore through suction tube 24. As the volume defined by the end of vane 58 and the contact point of the roller 54 with the outside perimeter of the bore 55 is reduced in size by the rolling action of the roller the refrigerant will be compressed. As best shown in FIGS. 1, 5 and 6, compressed gas is discharged from the compression chamber through cylindrical relief 76 in cylinder 37, through opening 78 in the main bearing, past valve 80 and valve retainer 82 and into muffler space 84. A discharge muffler baffle 86 is shown having an opening 88 therein for discharging compressed gas directly from the space 84 into the compressor housing 10 and around motor 30 for cooling the motor windings 33.

Figure 4:
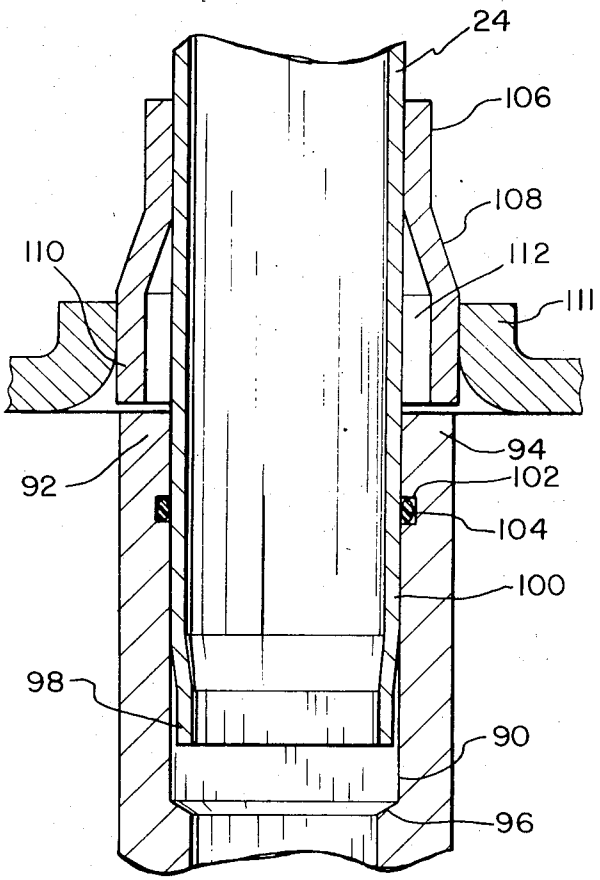
FIG. 4 is an enlarged sectional view of the suction tube connection to the housing and the cylinder.

The end portion of the suction tube end 24 within the housing 10 is received within an aperture 90 in the cylinder wall. Since it is desirable to have a thin cylinder 37 as explained hereinabove, the height or axial dimension of cylinder 37 is chosen to be small. Therefore, the amount of material of cylinder 37 surrounding the aperture 90 in the axial direction of cylinder 37 is relatively small. This material is indicated at numerals 92 and 94 in FIG. 4. Cylinder 37 is preferably constructed of cast iron which is somewhat porous. The porosity of the cylinder material determines the minimum dimension of the thickness of the material surrounding the aperture 90 such as portions 92 and 94 since it is desired to prevent leakage of any refrigerant through the walls of the cylinder 37. If the thickness of the cylinder material surrounding the aperture 90 is made too small, compressed refrigerant might escape through the pores of the cylinder material. The minimum material thickness to prevent leakage has been found to be thirty-seven thousandths of an inch. If this dimension is chosen to be smaller, the likelihood of leakage is increased due to the porosity of the material.

Unlike prior art structures, the inside diameter of the aperture 90 is greater than the outside diameter of suction tube 24. Tube 24 is not frictionally engaged by the cylinder walls but is slidable inside aperture 90. Aperture 90 communicates with the bore of the cylinder and includes a shoulder portion 96 to prevent tube 24 from entering too far into the aperture. The tube end portion 100 also has a reduced diameter portion 98 at its end to aid the entry of tube 24 into aperture 90 during assembly.

Aperture 90 is encircled by a circular recess 102. Recess 102 has a sealing ring 104 located therein. The sealing ring 104 may be an O ring constructed of a flexible material or any other suitable flexible sealing ring. The material for the O ring should be resistant to oil as the compressor contains lubricating oil, which will contact sealing ring 104. One material which has been found to be suitable is Bunham which is an oil resistant neoprene rubber.

As explained above, the suction tube 24 is not fastened into the aperture 90 but is in frictional engagement with O ring 104 and is slidably received within the aperture. The suction tube 24 is secured to the compressor housing by being attached to a suction tube adapter 106 as by soldering. Adapter 106 is cylindrical in shape and has a frusto-conical section 108. The lower portion 110 of adapter 106 is spaced away from suction tube 24 so that a void or space 112 exists between portion 110 and suction tube 24. Lower portion 110 is soldered to an upstanding flange 111 of housing 10. By way of this construction, when adapter 106 is soldered to suction tube 24 the heat produced by the soldering process is transferred away from suction tube 24 by means of frusto-conical portion 108, cylindrical portion 110 and into the housing 10 of the compressor thereby preventing scorching of the O ring 104.

As the compressor housing 10 flexes because of changing pressures inside the housing, suction tube 24 and end 100 thereof will move axially together with adapter 106 with respect to the cylinder 37. Since tube end 100 is slidably received within the cylinder aperture 90, a proper seal is maintained between the tube and the cylinder by flexible O ring 104.

By eliminating the need for swedging or pressuring the suction tube end 100 into the cylinder aperture 90 and thus keeping the distortion forces on the cylinder 37 to a minimum, a thin compressor cylinder 37 can be used. The leakage paths between vane 58, roller 54 and cylinder vane slots 59 are thus kept at a minimum. The efficiency of the compressor is thereby greatly improved over the efficiency of prior art structures. In addition, by using a thin cylinder, heat transfer between cylinder 37 and the refrigerant gas is greatly reduced, thus further improving the efficiency of the compressor.

What has been provided is a rotary hermetic compressor of simple construction having a high side housing 10 and a thin cylinder 37 and having a high degree of efficiency by the utilization of a very effective seal 104 between the suction tube 24 and the cylinder 37.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A hermetic rotary compressor comprising:

a housing;

an electric motor operatively disposed within said housing and having a rotatable rotor;

a unitary suction tube sealingly secured to said housing and having an end portion thereof extending into said housing;

a cylinder disposed within said housing in axial alignment with said rotor and connected to the interior wall of said housing, said cylinder having a cylindrical bore therein;

a rotatable crankshaft received within said bore and driven by said rotor for driving a piston means inside said bore and compressing refrigerant therein;

a discharge port in said cylinder for discharging compressed refrigerant from said bore;

an aperture in the cylindrical wall of said cylinder in communication with said bore;

said suction tube end portion having a smaller outside diameter than the inside diameter of the aperture, said tube end being axially slidably disposed within said aperture;

resilient sealing means for sealing said suction tube end in said cylinder aperture and preventing refrigerant from leaking past said suction tube sealing means while permitting axial movement of said tube end in said aperture; and a suction tube adapter means for securing the suction tube to the cylinder housing, said adapter means comprising a first cylindrical flange member adapted to fit over said tube and in contact with said tube, said adapter including a second cylindrical portion having a diameter greater than the outside diameter of said suction tube, a third transition portion for connecting said first and second portions, said second portion being in intimate contact with the housing of said compressor.

2. The compressor of claim 1 wherein said compressor is a rotary hermetic compressor and said piston comprises a vane and a roller connected to said crankshaft eccentric to said crankshaft axis.

3. A rotary hermetic compressor for compressing refrigerant comprising:

a hermetically sealed housing;

an electric motor located in said housing and secured to an inside wall thereof;

a suction tube having an end thereof extending through the wall of said housing, and sealingly connected thereto for conducting refrigerant to said compressor;

a crankshaft connected to said motor and rotatably driven thereby;

cylinder means secured to said housing and having a bore therein;

an aperture in the wall of said cylinder, said aperture communicating with said bore;

said suction tube end slidably received in said aperture;

flexible sealing means interposed between said aperture and the outside wall of said tube for forming a seal between the suction tube and the wall of said aperture while permitting slidable axial movement of said tube in said aperture; and adapter means for fixedly connecting said tube to said housing to prevent relative movement therebetween, said adapter means comprising a first clyindrical flange, said tube extending through said flange and secured thereto, and a second cylindrical flange portion secured to said housing, said first and second portions being joined by a frusto-conical portion.

4. The compressor according to claim 3 wherein said flexible sealing ring comprises a neoprene O-ring.

5. The compressor according to claim 3 wherein said thickness of cylinder wall material surrounding said aperture is no less than 37 thousandths of an inch.

6. A compressor for compressing refrigerant comprising:

a flexible housing;

an electric motor secured to an inside wall of said housing;

a crankshaft within said housing rotatably connected to said motor;

a main bearing secured to the inside wall of said housing;

a cylinder located inside said housing and connected to said main bearing, at least a portion of said cylinder being radially spaced from said housing, said housing wall being movable with respect to a side wall of said cylinder, said cylinder having a compression chamber therein;

piston means operably connected to said crankshaft for compressing refrigerant within said chamber;

discharge means in said cylinder in operative association with said chamber for discharging compressed refrigerant;

an aperture in said cylinder wall in communication with said compression chamber;

a suction tube having an end extending into said housing, said tube being sealingly and rigidly connected to said housing whereby said tube end moves relative to said cylinder when said housing flexes, said tube end being axially slidably received with said aperture;

a suction tube adapter means for securing the suction tube to the housing, said adapter means comprising a cylindrical flange member adapted to fit over said suction tube, said adapter having a first portion secured to said suction tube and a second portion spaced away from said suction tube, said second portion being in contact with said housing; and an O-ring constructed of oil resistant resilient material interposed between the wall of said aperture and the tube wall for sealing said tube end in said cylinder aperture while permitting axial movement of said tube in said aperture whereby said suction tube end moves with said housing and slides axially in said aperture upon movement of said housing.

7. A hermetic rotary compressor comprising:

a housing including a flexible housing wall;

an electric motor operatively disposed within said housing and having a rotatable rotor;

a unitary suction tube sealingly and rigidly secured to said housing and having an end portion thereof extending into said housing;

a cylinder disposed within said housing in axial alignment with said rotor and connected to the interior wall of said housing, at least a portion of said cylinder being spaced from said housing wall, said housing wall being movable with respect to the side wall of said cylinder, said cylinder having a cylindrical bore therein, said housing wall being radially movable with respect to said cylinder side wall;

a rotatable crankshaft received within said bore and driven by said rotor for driving a piston means inside said bore and compressing refrigerant therein;

a discharge port in said cylinder for discharging compressor refrigerant from said bore;

an aperture in the cylindrical wall of said cylinder in communication with said bore;

said suction tube end portion having a smaller outside diameter than the inside diameter of the aperture, said tube end being axially slidably disposed within said aperture, whereby said suction tube end moves with said housing when said housing wall flexes and said suction tube end slides axially within said aperture;

a suction tube adapter means for securing the suction tube to the cylinder housing, said adapter means comprising a first cylindrical flange member adapted to fit over said tube and in contact with said tube, said adapter including a second cylindrical portion having a diameter greater than the outside diameter of said suction tube, and a third transition portion for connecting said first and second portions, said second portion being in intimate contact with the housing; and a resilient neoprene O-ring for sealing said suction tube end in said cylinder aperture and preventing refrigerant from leaking past said suction tube sealing means while permitting axial movement of said tube end in said aperture when said suction tube moves with said housing wall.

* * * * *